United States Patent [19]

Rozett

[11] 3,995,450

[45] Dec. 7, 1976

[54] KNITTING MACHINE PERFORMANCE REGULATING SYSTEM

[75] Inventor: Lawrence Rozett, Flushing, N.Y.

[73] Assignee: The Singer Company, Elizabeth, N.J.

[22] Filed: May 8, 1975

[21] Appl. No.: 575,858

[52] U.S. Cl. ..... 66/8; 66/1 R; 66/157

[51] Int. Cl.[2] ..... D04B 9/00

[58] Field of Search ..... 66/154 A, 157, 8, 56, 66/163, 1 R

[56] References Cited

UNITED STATES PATENTS

| | | | |
|---|---|---|---|
| 3,327,499 | 6/1967 | Schmidt | 66/154 A X |
| 3,406,539 | 10/1968 | Wiesinger et al. | 66/56 |
| 3,449,931 | 6/1969 | Kawakami et al. | 66/157 |
| 3,561,565 | 2/1971 | Woor | 66/8 UX |
| 3,670,527 | 6/1972 | Bourgeois | 66/154 A X |
| 3,680,331 | 8/1972 | Morat | 66/154 A X |
| 3,757,536 | 9/1973 | Clairborne | 66/1 R |
| 3,785,177 | 1/1974 | Hino et al. | 66/157 |
| 3,888,095 | 6/1975 | Philip | 66/163 |
| 3,910,074 | 10/1975 | Parker | 66/157 |
| 3,940,954 | 3/1976 | Romoli | 66/157 |
| 3,967,471 | 7/1976 | Matsumoto et al. | 66/163 X |

FOREIGN PATENTS OR APPLICATIONS

| | | | |
|---|---|---|---|
| 1,923,099 | 3/1970 | Germany | 66/56 |

*Primary Examiner*—Mervin Stein
*Assistant Examiner*—A. M. Falik
*Attorney, Agent, or Firm*—Edward L. Bell; Robert E. Smith; Julian Falk

[57] ABSTRACT

A knitting machine is disclosed in which measurements are made reflecting the output characteristics such as the forces incident to the operation of the knitting needles relatively to operating cam means therefor, and a system is provided for influencing one or more of the operating characteristics of the knitting machine such as speed of operation, rate of lubrication, or the like, in response to such measurements.

6 Claims, 9 Drawing Figures

KNITTING MACHINE PERFORMANCE REGULATING SYSTEM

BACKGROUND OF THE INVENTION

Systems have been utilized in knitting machines for measuring unit fabric length and automatically regulating yarn feed in response thereto, for instance, to knit stockings of uniform length as disclosed in U.S. Pat. No. 2,856,764 of Cardin, or automatically to produce fabric of a predetermined density as disclosed in U.S. Pat. No. 3,225,570 of L. Mishcon. Automatic surveillance of knitting machine operation has not been utilized heretofore to optimize productivity of the knitting machine.

The formation of knitted fabric is accomplished in a knitting machine by driving needles lengthwise back and forth along slots in a needle bed causing the needles to engage and draw loops of yarn through yarn loops previously concatenated about the needles. The most commonly used arrangement for driving the needles lengthwise involves the interaction of butts on the needles or on jacks associated therewith and angled cam means such as raising or stitch cams. Indeed, even in the most sophisticated knitting machines using pattern wheels, drums or electronic devices for needle selection, such angled cams are invariably utilized for imparting the most basic stitch forming motions to the needles.

The rate at which the needles can be moved in any given knitting machine determines the productivity of the machine. It is desirable for greatest economy that the machines be operated at the maximum speed commensurate with the prescribed standard of perfection for the resulting knitted fabric. Currently, it is the practice to establish the maximum machine speed empherically and to operate the machine at a constant rate with reference to such empherical determination without regard to short term fluctuations in machine operating characteristics. As currently practiced, therefore, it is virtually a certainty that knitting machines will at times being operated at speeds higher than optimum so as to produce unnecessary fabric defects or unnecessarily severe operating conditions while at other times the machines are being operated at speeds lower than is optimum and unncessarily sacrificing productivity.

SUMMARY OF THE INVENTION

It is an object of this invention to provide a system for regulating the performance of a knitting machine to obtain maximum productivity without sacrifice of fabric quality. This object is attained by applying to a knitting machine one or more detectors monitoring, for instance, the forces generated by the operation of the knitting needles, fabric quality and the like, and providing a system effective in response to the level of detector output and in accordance with particular combinations of detector output to cause specific changes to take place in the knitting machine operating characteristics such as quality and distribution of lubrication, machine speed, etc. so that maximum productivity might be obtained.

DESCRIPTION OF THE DRAWINGS

With the above and other objects and advantages in view as will hereinafter appear, a preferred embodiment of this invention will now be described with reference to the accompanying drawings in which:

Referring to the drawings, FIG. 1 illustrates a conventional circular knitting machine indicated generally at 11 and including a frame 12 above which a yarn stand 13 is supported. Mounted to turn about a vertical axis in the frame are the needle beds including a hollow needle cylinder 14 surmounted by needle dial 15, and below both needle beds is a fabric take up mechinism 16, these all being rotated in unison relatively to the frame by a drive unit 17 which may include an electric drive motor 18, a suitable transmission 19 and any known speed regulating means 20.

As shown best in FIG. 2, conventional latch type knitting needles 21 are endwise reciprocable in vertical slots 22 in the needle cylinder 14 as well as in radial slots 23 in the dial 15. The cylinder needles are shifted endwise by instrumentalities carried on individual section blocks 24 secured to the frame exteriorly of the cylinder. Similarly the dial needles are influenced by instrumentalities carried on radially arranged section blocks 25 above the dial. FIGS. 3 & 5 illustrate the needle influencing instrumentalities arrayed on the inside surface of a typical cylinder and dial section block 24 and 25 respectively. For an understanding of this invention, it will be sufficient to understand that each knitting needle is provided with a butt 26 protruding from the needle bed and adapted to be influenced by angled cam means or other instrumentalities carried on the section blocks. As shown in FIG. 3, each cylinder section block 24 carries an angled stitch cam 30 which is fastened against a back up plate 31 on the section block and serves to draw the cylinder needles downwardly in the stitch forming stroke during which a yarn 32 which proceeds from one of the cops 33 on the yarn stand and through suitable guide means 34 is drawn by the needles in loops through yarn loops previously concatenated about the needles.

As shown in FIG. 5, each dial section block 25 also carries an angled stitch cam 40 similarly arranged against a back up plate 41 on the section block and serving a similar needle drawing function with respect to the dial needles.

Figure 1:
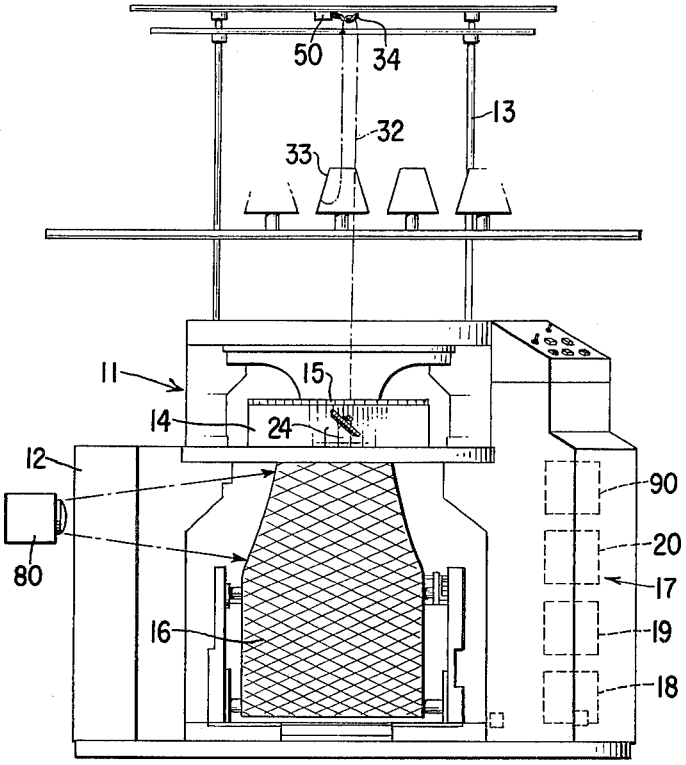
FIG. 1 represents a circular knitting machine to which this invention is applied.

The needles in traversing each section block have their butts 26 influenced by various reciprocating means including the angled stitch cams 30 or 40 so as to knit one additional spiral row of stitches into the resulting fabric tube which is drawn down and wrapped on the take up mechanism 16.

In the brief description of a knitting machine operation above, a number of particular measurable characteristics might be identified incident to the knitting machine operation which indicate whether or not the machine operation is proceeding normally. Such characteristics might, by way of example include, (1) the integrity and tension in each yarn 32 delivered to the knitting needles, (2) the force generated as the needle butts are influenced by the angled stitch cams 30 and 40, and (3) the presence or absence of holes in the knitted fabric resulting from dropped stitches.

Each of the above enumerated characteristics is capable of detection or measurement. Other characteristics also capable of being measured will undoubtedly suggest themselves to those skilled in the art.

The yarns 32 may be monitored for continuity and tension by any known stop motion device 50 which may be associated with the yarn guide 34 or by a means of a strain gauge 51 such as that manufactured by Kulite Semi Conductor Co., 1030 Hoyt Avenue, Richfield, N.J. and identified as Ser. No. UGP 500–10 applied, for instance, by epoxy to the guide 34 in such a way as to measure the deflection of the yarn guide 34.

The force generated by the needle butts coacting with the angled cams 30 and 40 may be monitored by strain gauges 60 and 70 applied to the back-up plates 31 and 41, respectively. The strain gauges may comprise the Piezo-resistive type manufactured by Kulite Semi Conductor Co., 1030 Hoyt Ave., Richfield, N.J. and identified as Ser. No. UGP 1000–060.

Other known types of strain gauges may also be used, for instance, electro-resistance wire or foil types, inductance or capacitive types, or Piezo-electric transducer types.

Figure 3:
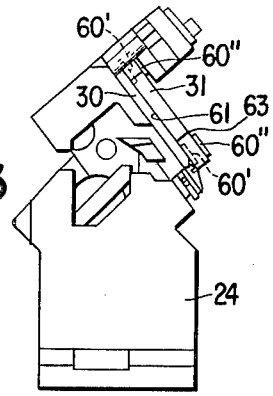
FIG. 3 is an enlarged view of the inside face of one cylinder section block.
Figure 4:
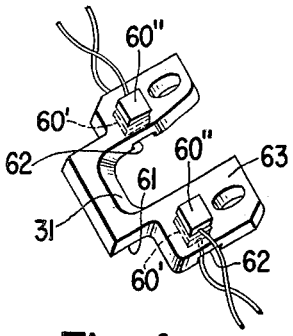
FIG. 4 is an enlarged elevational view of a stitch cam back-up plate from the cylinder section block.

With reference to FIGS. 3 and 4, an arrangement is illustrated in which four strain gauges 60 are applied each in a different location on the back-up plate 31. Preferably two of the strain gauges 60' are applied as by epoxy cement or the like to the surface 61 of the back-up plate 31 against which the angled cam 30 is contiguous. Since the strain gauge seeks to measure the deflection of the back-up plate and not compression forces applied directly against the strain gauges, the strain gauges 60' are preferably arranged in shallow recesses 62 cut onto the surface 61 of the back-up plate 31. Two additional strain gauges 60'' are cemented to the side 63 of the back-up plate which is opposite that facing the angled cam 30. Although a single strain gauge might be used, use of a plurality which are coupled, for instance, in a bridge circuit may be advantageous in increasing the sensitivity of the detector, in balancing the effect of temperature distribution in the knitting machine, and in minimizing localized stress concentration.

Figure 7:
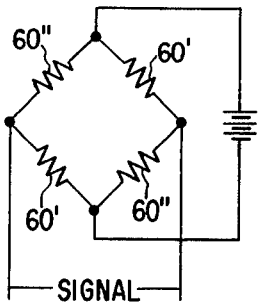
FIG. 7 is an electrical wiring diagram illustrating one possible arrangement for providing a composite signal from a plurality of strain gauges applied to one cam back-up plate.

FIG. 7 illustrates a bridge circuit in which the four strain gauges 60 are connected with a source of electricity and arranged to provide as a signal a composite result of the strain detected by each of the gauges.

Figure 5:
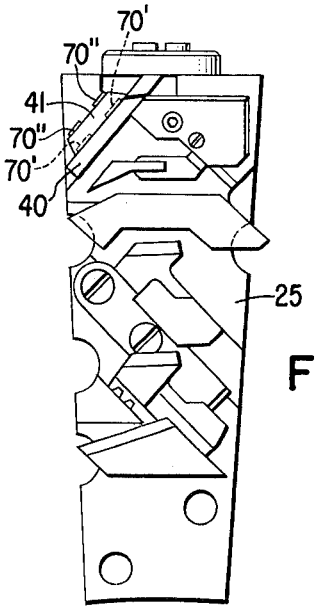
FIG. 5 is an enlarged view of the bottom face of one dial section block.
Figure 6:
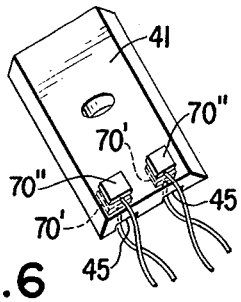
FIG. 6 is an elevational view of a stitch cam from the back-up plate dial section block.

A similar arrangement of four strain gauges 70 is illustrated on the dial back-up plate 41 shown in FIGS. 5 and 6 with two strain gauges 70' arranged in recesses 45 at one side and two strain gauges 70'' arranged at the opposite side.

The presence of dropped stitches in the knit fabric may be detected by an optical drop stitch detecting unit 80 such as that manufactured by Wesco Co., 155 Ames Court, Plainview, N.Y. and identified as SICK optical Needle Sensor NK 20.

In the knitting machine described above a number of means exist or may be applied to the machine for varying the conditions influencing the operation of the knitting needles.

The speed control unit 20 provides one such means which can exert a profound influence on the operation and result of the knitting needle operation.

A clutch motion device 90 of any known construction may also be associated with the transmission 19 for quickly bringing the knitting machine to an at rest condition.

Figure 2:
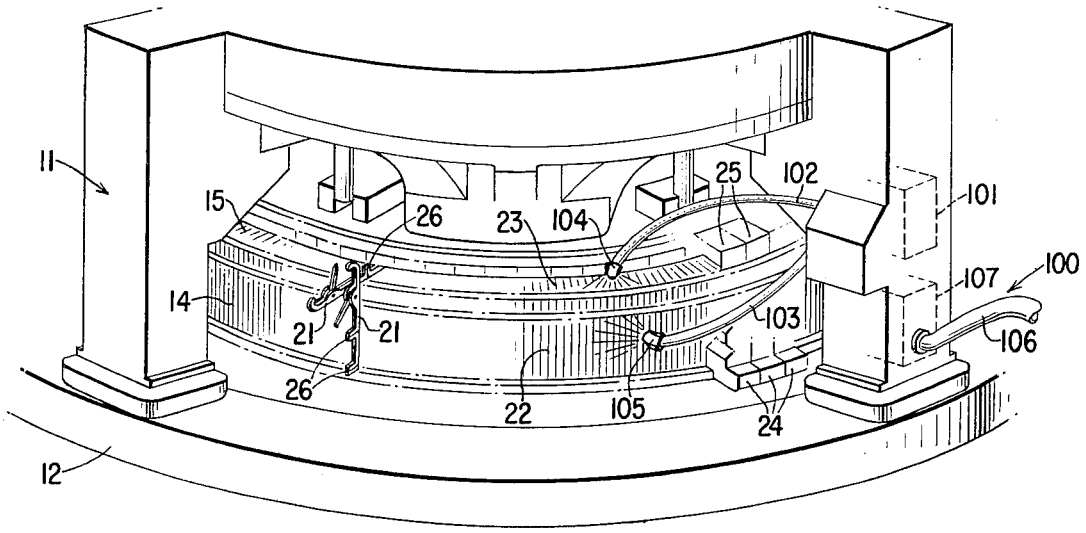
FIG. 2 is an enlarged view of a portion of the knitting machine of FIG. 1 showing the needle beds and only a portion of the cam supporting section blocks.

As shown in FIG. 2 still another means for influencing operation of the knitting needles is a lubricating system indicated generally at 100. The system 100 may comprise a reservoir 101 and distribution hoses 102, 103 terminating in nozzles 104 and 105 respectively for applying lubricant in a fine mist to the needles 21 and to the needle slots 22 and 23 in the cylinder and dial. The system 100 may include provision 106 for introducing a lubricant carrying medium such as compressed air and preferably includes a control means 107 for regulating the amount of lubricant delivered.

In the present invention the number of different detectors and the numbers of different characteristics of knitting machine operation which are detected may vary from a single detector of one characteristic to a large number of detectors of many different characteristics.

Similarly, the number of means for influencing knitting machine operations which are varied in response to the detectors may vary from one to many.

Figure 8:
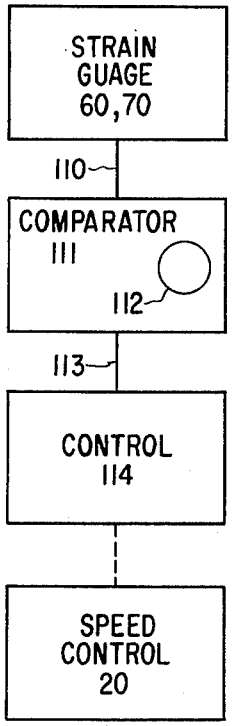
FIG. 8 is a block diagram indicating one organization of the performance regulating system of this invention.

One example of a performance regulating system which may be applied to a knitting machine in accordance with this invention is illustrated in FIG. 8 and comprises the use of strain gauges 60, 70 to provide a signal indicative of the forces existant between the needle butts and the angled cams 30, 40 about the knitting machine. The signal reflecting the force condition at the stitch cams is delivered via a line 110 to a comparator 111 which includes a manually adjustable control 112 for predetermining a norm value against which that delivered via line 110 is compared. A resulting deviation signal is delivered from the comparator via line 113 to an actuator 114 such as a servo motor or the like which is operatively associated with the speed control unit 20 of the knitting machine drive motor. Preferably the servo motor is adapted to decrease the knitting machine speed of operation upon receipt of a deviational signal indicating a force condition greater than a predetermined norm.

Thus by measuring the forces transmitted to one or more angled cams in the machine and by processing this data automatically to increase or decrease the speed of the machine to maintain a constant force on the needles irrespective of changes to the internal conditions of the machine, a constant maximum safe force can be maintained on the needles, not only protecting the needles against undue wear or breakage but insuring the maximum yield of a knit fabric commensurate with machine safety.

The present invention also comprehends more complicated systems in which a variety of knitting machine characteristics are monitored and a variety of conditions influencing operation of the knitting machine are varied in response thereto.

Figure 9:
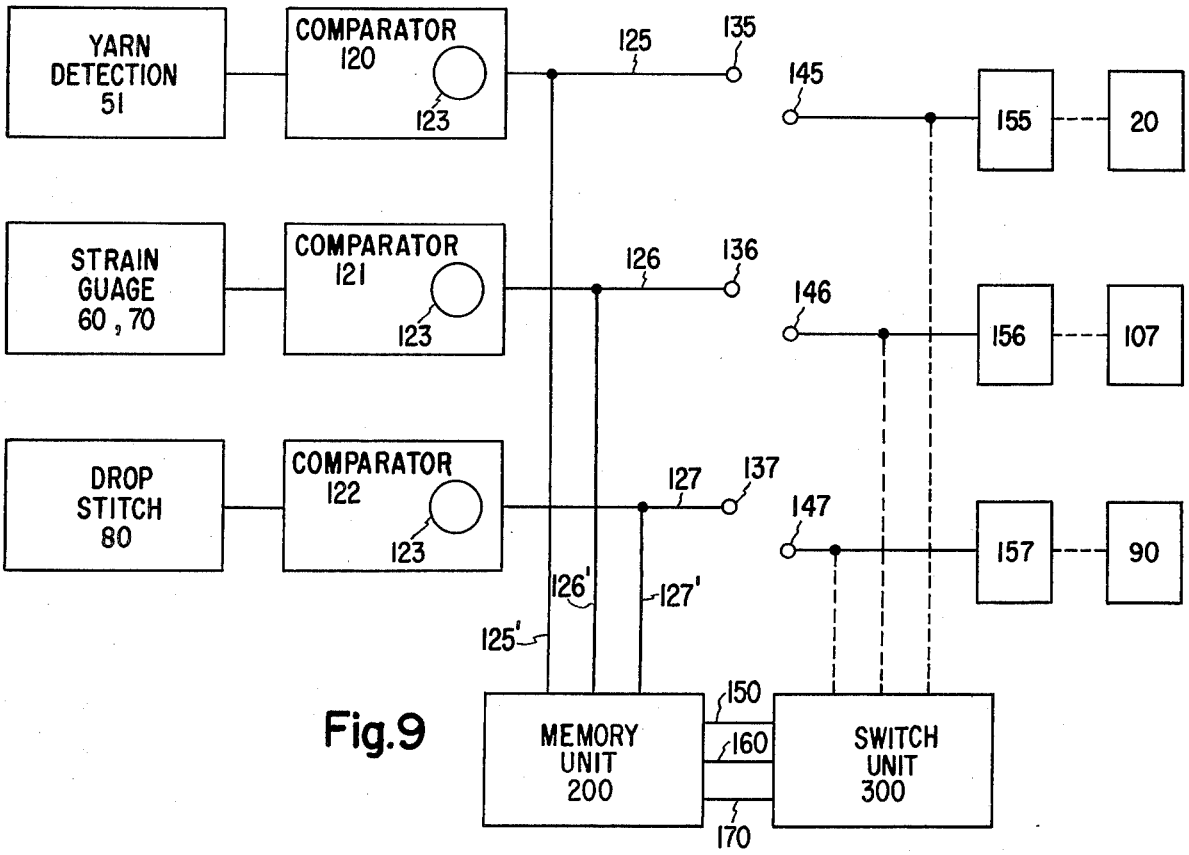
FIG. 9 is a block diagram indicating a modified organization of the performance regulating system of this invention.

FIG. 9 illustrates a system which will now be described by way of example in which three characteristics are separately monitored i.e. the yarn tension and continuity as detected by a strain gauge unit 51; the forces transmitted to one or more angled cams 30 or 40 as detected by the strain gauges 60, or 70; and the existence of dropped stitches as detected by an optical drop stitch detector 80.

Comparators 120, 121 and 122 may be associated one with each of the above enumerated detectors, each comparator preferably including a manually adjustable control 123 for predetermining a norm value. The output lines 125, 126 and 127 respectively from each comparator thus deliver to switch junctions 135, 136 and 137, respectively, an error signal reflecting the monitored characteristic as compared with a predetermined norm.

Each of the output lines 125, 126 and 127 is joined by a branch 125', 126' and 127' respectively, and the branches are directed to a read-only-memory unit 200 which, as is well known in the art, may be preprogrammed to apply different sets of instructions on output lines 150, 160 and 170, each different set of instructions being rendered effective by the application thereto of a particular address input appearing in binary code on the branch lines 125', 126' and 127' leading into the memory unit 200. These different sets of instructions may, for instance, influence different predetermined positions of a switch means 300 influenced by the output condition on lines 150, 160 and 170.

The switch unit 300 may be operatively arranged selectively to establish electrical connection between any one or more of the switch junctions 135, 136 and 137 and any one or more of junctions 145, 146 and 147 which are associated each with an actuator 155, 156 and 157, respectively, for the various devices by which the operating conditions of the knitting machine may be varied. These devices for varying knitting machine conditions may comprise the machine speed regulating means 20, the control means 107 for regulating the amount of lubricant delivered and the stop motion device 90 respectively.

With the lines 125', 126' and 127' leading to the memory unit assigned a significance of 1, 2 and 4 respectively in binary code it will be apparent that any one of seven different addresses in the memory may be identified by any given combination of these detector outputs.

Assuming, as an instance, that only the strain gauges 60 ,70 signal an abnormal increase in forces applied to the angled cam by the needle butts. As a result, a voltage generated by the comparator 121 via line 126' will result in an input to the memory unit 200 corresponding to a binary number having significance of 2 in the base 10. At this location in the memory unit 200, the instruction to the switch unit 300 may be to connect electrically the control junctions 136 and 146 allowing the signal from the line 126 to be applied to the actuator 156 resulting in an increase of lubricant flow.

The memory unit may be also preprogrammed at any given address to provide for additional instructions should the condition persist longer than a predetermined period of time. For instance, an initial instruction may be given to connect the control junctions 136 and 146 as described above, and should the resulting increased lubricant not alleviate the abnormal high force condition on the needle cams within a specific time, further instructions may be given, as for instance, by the operation of a time delay relay to additionally connect the control junction 136 with the junction 145 to reduce the speed of machine operation. Again after a specific period of time should the condition persist, instruction may be issued further to connect the control junction 136 with the junction 147 to stop the machine.

What is claimed is:

1. In a knitting machine having knitting needles operable to concatenate yarn into a knitted fabric, actuating mechanism for operating said knitting needles, a device associated with said knitting machine for varying at least one condition influencing the operation of said knitting needles to any graduated amount within a predetermined range, a detecting device on said knitting machine providing a signal which varies proportionately in response to forces incident to and resulting from the operation of said knitting needles, means for comparing said varying signal with a predetermined norm and for delivering a proportionate error signal, and control means responsive to the proportions of said error signal during continued operation of said actuating mechanism for operating said condition varying means to maintain continued operation of said knitting machine at maximum productivity.

2. In a knitting machine having knitting needles operable to concatenate yarn into a knitted fabric, actuating mechanism for operating said knitting needles, a plurality of different devices associated with said knitting machine each effective for varying a different condition influencing the operation of said knitting needles, a detecting device on said knitting machine providing a signal in response to a particular characteristic incident to the operation of said knitting needles, and control means for initiating operation of each one of said plurality of different condition varying devices in a predetermined sequence each in response to continuous provision of said signal for different predetermined period of time.

3. In a knitting machine having knitting needles operable to concatenate yarn into a knitted fabric, actuating mechanism for operating said knitting needles, means for varying in graduated amount at least one condition influencing the continued operation of said knitting needles, separate detecting devices on said knitting machine each providing a signal in response to a different particular characteristic incident to and resulting from the operation of said knitting needles, and control means responsive to signals from any combination of said separate detecting devices for operating said condition varying means to maintain continued operation of said knitting machine at maximum productivity.

4. In a knitting machine having knitting needles operable to concatenate yarn into a knitted fabric, actuating mechanism for operating said knitting needles, means for stopping said knitting machine, separate means in addition to said stopping means each effective for varying a different condition influencing the operation of said knitting needles, separate detecting devices on said knitting machine each providing an identifiable signal responsive to a different particular characteristic incident to and resulting from the operation of said knitting machine needles, a programming means on said knitting machine adapted to receive and identifiable detecting device signals, said programming means being effective to influence operation of said separate condition varying means in a predetermined unique sequence and timed relationship in response to each different combination of said identifiable detecting device signals.

5. In a knitting machine as set forth in claim 4 in which said separate detecting devices comprise a force detecting unit responsive to abnormal forces incident to the operation of said knitting needles and a dropped stitch detector responsive to the condition of the knitted fabric, and in which said separate condition varying means comprise lubrication means for said knitting needles, speed control means for said actuating mechanism, and stop motion means for suspending operation of said actuating mechanism.

6. In a knitting machine having a bed with needle accomodating slots knitting needles endwise reciprocable in said slots to concatenate yarn into knitted fabric, angled cam means carried on said knitting machine and cooperating with said needles to influence said endwise reciprocation, and drive means for imparting motion to said angled cam means relatively to said knitting needles, at least one detector means on said knitting machine for providing a signal responsive to abnormal forces arising as a result of the interaction between said knitting needles and said angled cam means, speed control means associated with said drive means, and means responsive to variations in the output signal of said detector means for influencing proportional variations in the operation of said speed control means to maintain continued operation of said knitting machine at optimum productivity.

* * * * *